US007992590B2

(12) United States Patent
Meehan et al.

(10) Patent No.: US 7,992,590 B2
(45) Date of Patent: Aug. 9, 2011

(54) FAUCET SPOUT WITH WATER ISOLATING COUPLINGS

(75) Inventors: Steven Kyle Meehan, Fishers, IN (US); Christopher Michael McGuire, Fishers, IN (US); Brian Matthew Jolliffe, Carmel, IN (US); Jeffrey Lee Moore, Frankfort, IN (US); Darrell Scott Crowe, Lebanon, IN (US); Derek Allen Brown, Lizton, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 556 days.

(21) Appl. No.: 12/228,305

(22) Filed: Aug. 12, 2008

(65) Prior Publication Data

US 2008/0308165 A1 Dec. 18, 2008

Related U.S. Application Data

(62) Division of application No. 11/313,136, filed on Dec. 20, 2005, now Pat. No. 7,415,991.

(51) Int. Cl.
*F16K 21/00* (2006.01)

(52) U.S. Cl. ..... 137/801; 138/114; 285/305; 285/403

(58) Field of Classification Search ..... 137/801; 4/675–678, 695; 285/305, 403; 138/108, 138/112, 114

See application file for complete search history.

(56) References Cited

U.S. PATENT DOCUMENTS 2,200,091 A 5/1940 Kovach
2,219,471 A 10/1940 Davis
2,546,327 A 3/1951 Young
2,548,933 A 4/1951 Barnett
2,781,786 A 2/1957 Young
2,884,007 A 4/1959 Green
3,229,710 A 1/1966 Keller, III
3,422,849 A 1/1969 Manoogian
3,505,098 A 4/1970 Miller et al.
3,520,325 A 7/1970 Stuart
3,580,289 A 5/1971 James et al.

(Continued)

FOREIGN PATENT DOCUMENTS

DE 10133041 1/2003

(Continued)

OTHER PUBLICATIONS

Dadex Polydex—PPR Pipe System for Hot and Cold Water Supply and Distribution, 2005, 2 pgs.

(Continued)

*Primary Examiner* — Craig Schneider
(74) *Attorney, Agent, or Firm* — Baker & Daniels LLP

(57) ABSTRACT

A faucet including a spout body formed of metal and having an inlet end, an outlet end and a chamber extending between inlet and outlet ends. A tube formed of a non-metallic material is enclosed within the chamber and has receiving and dispensing ends. Tube defines a passage extending between receiving and dispensing ends. Receiving end is in fluid communication with water source to communicate water through passage. An inlet coupling formed of a non-metallic material and having an inlet opening extending therethrough is molded about receiving end such that receiving end is sealingly received within inlet opening. An outlet coupling formed of a non-metallic material and having an outlet opening extending therethrough is molded about dispensing end such that dispensing end is sealingly received within outlet opening. Inlet and outlet couplings are sealingly coupled to inlet and outlet ends of spout body, respectively.

14 Claims, 8 Drawing Sheets

U.S. PATENT DOCUMENTS

| | | | |
|---|---|---|---|
| 3,590,876 | A | 7/1971 | Young |
| 3,600,723 | A | 8/1971 | Mongerson et al. |
| 3,757,824 | A | 9/1973 | Parkhurst et al. |
| 3,796,380 | A | 3/1974 | Johnson et al. |
| 3,807,453 | A | 4/1974 | Dom et al. |
| 3,854,493 | A | 12/1974 | Farrell |
| 3,965,936 | A | 6/1976 | Lyon |
| 3,989,787 | A | 11/1976 | Scott, Jr. et al. |
| 3,998,240 | A | 12/1976 | Liautaud |
| 4,026,328 | A | 5/1977 | Nelson |
| 4,076,279 | A | 2/1978 | Klotz et al. |
| 4,103,709 | A | 8/1978 | Fischer |
| 4,130,136 | A | 12/1978 | Garnier et al. |
| 4,221,338 | A | 9/1980 | Shames et al. |
| 4,316,870 | A | 2/1982 | Rowley |
| 4,337,795 | A | 7/1982 | Argyris et al. |
| 4,356,574 | A | 11/1982 | Johnson |
| 4,357,957 | A | 11/1982 | Bisonaya et al. |
| 4,387,738 | A | 6/1983 | Bisonaya et al. |
| 4,415,389 | A | 11/1983 | Medford et al. |
| 4,446,084 | A | 5/1984 | Rowley |
| 4,453,567 | A | 6/1984 | MacDonald |
| 4,458,839 | A | 7/1984 | MacDonald |
| 4,484,600 | A | 11/1984 | Peterson et al. |
| 4,502,507 | A | 3/1985 | Hayman |
| 4,513,769 | A | 4/1985 | Purcell |
| 4,525,136 | A | 6/1985 | Rowley |
| 4,552,171 | A | 11/1985 | Farrell et al. |
| 4,577,835 | A | 3/1986 | Holycross, Jr. |
| 4,580,601 | A | 4/1986 | Schlotman et al. |
| 4,592,388 | A | 6/1986 | Wilcox |
| 4,607,659 | A | 8/1986 | Cole |
| 4,610,429 | A | 9/1986 | Arnold et al. |
| 4,626,005 | A | 12/1986 | Stifter |
| 4,635,673 | A | 1/1987 | Gerdes |
| 4,649,958 | A | 3/1987 | Purcell |
| 4,652,263 | A | 3/1987 | Herweck et al. |
| 4,664,423 | A | 5/1987 | Rowley |
| 4,667,987 | A | 5/1987 | Knebel |
| 4,687,025 | A | 8/1987 | Kahle et al. |
| 4,700,928 | A | 10/1987 | Marty |
| 4,708,172 | A | 11/1987 | Riis |
| 4,754,993 | A | 7/1988 | Kraynick |
| 4,760,871 | A | 8/1988 | Vijay |
| 4,762,143 | A | 8/1988 | Botnick |
| 4,773,348 | A | 9/1988 | Rowley |
| 4,783,303 | A | 11/1988 | Imgram |
| 4,803,033 | A | 2/1989 | Rowley |
| 4,838,304 | A | 6/1989 | Knapp |
| 4,853,164 | A | 8/1989 | Kiang et al. |
| 4,877,660 | A | 10/1989 | Overbergh et al. |
| 4,887,642 | A | 12/1989 | Bernat |
| 4,942,644 | A | 7/1990 | Rowley |
| 4,957,135 | A | 9/1990 | Knapp |
| 4,971,112 | A | 11/1990 | Knapp |
| 4,979,530 | A | 12/1990 | Breda |
| 5,001,008 | A | 3/1991 | Tokita et al. |
| 5,006,207 | A | 4/1991 | Peterman et al. |
| 5,027,851 | A | 7/1991 | Drees et al. |
| 5,053,097 | A | 10/1991 | Johansson et al. |
| 5,090,062 | A | 2/1992 | Hochstrasser |
| 5,095,554 | A | 3/1992 | Gloor |
| 5,100,565 | A | 3/1992 | Fujiwara et al. |
| 5,110,044 | A | 5/1992 | Bergmann |
| 5,127,814 | A | 7/1992 | Johnson et al. |
| 5,131,428 | A | 7/1992 | Bory |
| 5,148,837 | A | 9/1992 | Ågren et al. |
| 5,150,922 | A | 9/1992 | Nakashiba et al. |
| 5,219,185 | A | 6/1993 | Oddenino |
| 5,232,008 | A | 8/1993 | Jeffress et al. |
| 5,279,333 | A | 1/1994 | Lawrence |
| 5,366,253 | A | 11/1994 | Nakashiba et al. |
| 5,375,889 | A | 12/1994 | Nakashiba et al. |
| 5,397,102 | A | 3/1995 | Kingman |
| 5,417,242 | A | 5/1995 | Goncze |
| 5,493,873 | A | 2/1996 | Donselman et al. |
| 5,494,259 | A | 2/1996 | Peterson |
| 5,518,027 | A | 5/1996 | Saiki et al. |
| 5,527,503 | A | 6/1996 | Rowley |
| 5,553,935 | A | 9/1996 | Burnham et al. |
| 5,555,912 | A | 9/1996 | Saadi et al. |
| 5,558,128 | A | 9/1996 | Pawelzik et al. |
| 5,566,707 | A | 10/1996 | Ching et al. |
| 5,573,037 | A | 11/1996 | Cole et al. |
| 5,577,393 | A | 11/1996 | Donselman et al. |
| 5,579,808 | A | 12/1996 | Mikol et al. |
| 5,590,572 | A | 1/1997 | Valente |
| 5,611,093 | A | 3/1997 | Barnum et al. |
| 5,615,709 | A | 4/1997 | Knapp |
| 5,622,210 | A | 4/1997 | Crisman et al. |
| 5,622,670 | A | 4/1997 | Rowley |
| 5,642,755 | A | 7/1997 | Mark et al. |
| 5,660,692 | A | 8/1997 | Nesburn et al. |
| 5,669,407 | A | 9/1997 | Bailey |
| 5,669,417 | A | 9/1997 | Lian-Jie |
| 5,669,595 | A | 9/1997 | Bytheway |
| 5,685,341 | A | 11/1997 | Chrysler et al. |
| 5,687,952 | A | 11/1997 | Arnold et al. |
| 5,695,094 | A | 12/1997 | Burnham et al. |
| 5,725,008 | A | 3/1998 | Johnson |
| 5,730,173 | A | 3/1998 | Sponheimer |
| 5,741,458 | A | 4/1998 | Rowley |
| 5,746,244 | A | 5/1998 | Woolley, Sr. et al. |
| 5,756,023 | A | 5/1998 | Stachowiak |
| 5,758,690 | A | 6/1998 | Humpert et al. |
| 5,775,587 | A | 7/1998 | Davis |
| 5,803,120 | A | 9/1998 | Bertoli |
| 5,813,435 | A | 9/1998 | Knapp |
| 5,833,279 | A | 11/1998 | Rowley |
| 5,850,855 | A | 12/1998 | Kerschbaumer et al. |
| 5,857,489 | A | 1/1999 | Chang |
| 5,861,200 | A | 1/1999 | Rowley |
| 5,865,473 | A | 2/1999 | Semchuck et al. |
| 5,875,809 | A | 3/1999 | Barrom |
| 5,893,387 | A | 4/1999 | Paterson et al. |
| 5,895,695 | A | 4/1999 | Rowley |
| 5,916,647 | A | 6/1999 | Weinstein |
| 5,924,451 | A | 7/1999 | Kuo |
| 5,927,333 | A | 7/1999 | Grassberger |
| 5,934,325 | A | 8/1999 | Brattoli et al. |
| 5,937,892 | A | 8/1999 | Meisner et al. |
| 5,944,225 | A | 8/1999 | Kawolics |
| 5,950,663 | A | 9/1999 | Bloomfield |
| 5,960,490 | A | 10/1999 | Pitsch |
| 5,965,077 | A | 10/1999 | Rowley et al. |
| 5,975,143 | A | 11/1999 | Järvenkylä et al. |
| 5,979,489 | A | 11/1999 | Pitsch |
| 6,013,382 | A | 1/2000 | Coltrinari et al. |
| 6,023,796 | A | 2/2000 | Pitsch |
| 6,029,860 | A | 2/2000 | Donselman et al. |
| 6,029,948 | A | 2/2000 | Shafer |
| 6,053,214 | A | 4/2000 | Sjoberg et al. |
| 6,062,251 | A | 5/2000 | Pitch |
| 6,070,614 | A | 6/2000 | Holzheimer et al. |
| 6,070,916 | A | 6/2000 | Rowley |
| 6,073,972 | A | 6/2000 | Rivera |
| 6,079,447 | A | 6/2000 | Holzheimer et al. |
| 6,082,407 | A | 7/2000 | Paterson et al. |
| 6,082,780 | A | 7/2000 | Rowley et al. |
| 6,085,784 | A | 7/2000 | Bloom et al. |
| 6,116,884 | A | 9/2000 | Rowley et al. |
| 6,123,232 | A | 9/2000 | Donselman et al. |
| 6,131,600 | A | 10/2000 | Chang |
| 6,138,296 | A | 10/2000 | Baker |
| 6,155,297 | A | 12/2000 | MacAusland et al. |
| 6,161,230 | A | 12/2000 | Pitsch |
| 6,170,098 | B1 | 1/2001 | Pitsch |
| 6,177,516 | B1 | 1/2001 | Hudak |
| 6,202,686 | B1 | 3/2001 | Pitsch et al. |
| 6,227,464 | B1 | 5/2001 | Allmendinger et al. |
| 6,238,575 | B1 | 5/2001 | Patil |
| 6,256,810 | B1 | 7/2001 | Baker |
| 6,270,125 | B1 | 8/2001 | Rowley et al. |
| 6,287,501 | B1 | 9/2001 | Rowley |
| 6,293,336 | B1 | 9/2001 | Emerick, Sr. et al. |
| 6,296,017 | B2 | 10/2001 | Kimizuka |
| 6,305,407 | B1 | 10/2001 | Selby |

| | | | |
|---|---|---|---|
| 6,315,715 | B1 | 11/2001 | Taylor et al. |
| 6,328,059 | B1 | 12/2001 | Testori et al. |
| 6,334,466 | B1 | 1/2002 | Jani et al. |
| 6,341,617 | B1 | 1/2002 | Wilson |
| 6,349,733 | B1 | 2/2002 | Smith |
| 6,378,790 | B1 | 4/2002 | Paterson et al. |
| 6,385,794 | B1 | 5/2002 | Miedzius et al. |
| 6,464,266 | B1 | 10/2002 | O'Neill et al. |
| 6,485,666 | B1 | 11/2002 | Rowley |
| 6,557,907 | B2 | 5/2003 | Rowley |
| 6,609,732 | B1 | 8/2003 | Souvatzidis et al. |
| 6,635,334 | B1 | 10/2003 | Jackson et al. |
| 6,722,011 | B1 | 4/2004 | Bacon |
| 6,732,543 | B2 | 5/2004 | Jenkins, Jr. et al. |
| 6,770,376 | B2 | 8/2004 | Chen |
| 6,770,384 | B2 | 8/2004 | Chen |
| 6,783,160 | B2 | 8/2004 | Rowley |
| 6,803,133 | B2 | 10/2004 | Chen |
| 6,817,379 | B2 | 11/2004 | Perla |
| 6,835,777 | B2 | 12/2004 | Botros |
| 6,838,041 | B2 | 1/2005 | Rowley |
| 6,848,719 | B2 | 2/2005 | Rowley |
| 6,860,523 | B2 | 3/2005 | O'Neill et al. |
| 6,860,524 | B1 | 3/2005 | Rowley |
| 6,877,172 | B2 | 4/2005 | Malek et al. |
| 6,894,115 | B2 | 5/2005 | Botros |
| 6,902,210 | B1 | 6/2005 | Rowley |
| 6,920,899 | B2 | 7/2005 | Haenlein et al. |
| 6,959,736 | B2 | 11/2005 | Järvenkylä |
| 6,962,168 | B2 | 11/2005 | McDaniel et al. |
| 6,978,795 | B2 | 12/2005 | Perrin |
| 7,118,138 | B1 | 10/2006 | Rowley et al. |
| 7,225,828 | B2 | 6/2007 | Giagni et al. |
| 2002/0100139 | A1 | 8/2002 | Rowley |
| 2002/0167171 | A1 | 11/2002 | Becker et al. |
| 2004/0007278 | A1 | 1/2004 | Williams |
| 2004/0021120 | A1 | 2/2004 | Turnau, III et al. |
| 2004/0060608 | A1 | 4/2004 | Angus |
| 2004/0117906 | A1 | 6/2004 | Baker et al. |
| 2004/0150132 | A1 | 8/2004 | Rowley |
| 2004/0176503 | A1 | 9/2004 | Czayka et al. |
| 2005/0005989 | A1 | 1/2005 | Roloff |
| 2005/0194051 | A1 | 9/2005 | Pinette |
| 2006/0108705 | A1 | 5/2006 | Rowley |
| 2006/0118185 | A1 | 6/2006 | Nobili |
| 2006/0124183 | A1 | 6/2006 | Kuo |
| 2006/0130908 | A1 | 6/2006 | Marty et al. |
| 2006/0170134 | A1 | 8/2006 | Rowley et al. |
| 2006/0202142 | A1 | 9/2006 | Marty et al. |
| 2007/0044852 | A1 | 3/2007 | Pinette |
| 2007/0137718 | A1 | 6/2007 | Rushlander et al. |

FOREIGN PATENT DOCUMENTS

| | | |
|---|---|---|
| EP | 0 632 220 | 1/1995 |
| EP | 0 808 952 | 11/1997 |
| JP | 3094877 | 4/1991 |
| JP | 200132343 | 6/2001 |
| WO | WO 91/05191 | 4/1991 |
| WO | WO 00/61831 | 10/2000 |
| WO | WO 02/25022 | 3/2002 |
| WO | WO 2005/108829 | 11/2005 |

OTHER PUBLICATIONS

Dadex Polydex, 2005, 1 pg.

Dow, Plastic Pipes Europe, Middle East & Africa, Hot and Cold Water Pipes, 2007, 1 pg.

Dow, Plastic Pipes Europe, Middle East, & Africa, Dowlex PE-RT, 2007, 2 pgs.

Kerox, Standard Cartridges, 2005, 3 pgs.

Ticona Engineering Polymers, Engineering Polymers for Innovative Applications catalog, Mar. 2006, 15 pgs.

International Search Report for PCT Application No. PCT/US06/33584, 8 pgs.

Noveon, Inc.; Processing with TempRite® PEX Ensures Quality Piping, www.tempritepex.com/processingInstallation/processing.asp, at least as early as Jun. 7, 2005, 2 pgs.

SpecialChem S.A., Silane Crosslinking Agents Center, Crosslinking Mechanism, www.specialchem4polymers.com/tc/silane-crosslinking-agents/index.aspx?id=mechanism, at least as early as Jun. 7, 2005, 2 pgs.

PPI Plastics Pipe Institute, Crosslinked Polyethylene (PEX) Tubing, TN-17/2001, www.plasticpipe.org/pdf/pubs/notes/tn17-01.pdf, Jun. 2001, 7 pgs.

FAUCET SPOUT WITH WATER ISOLATING COUPLINGS

CROSS-REFERENCED TO RELATED APPLICATION

This application is a divisional of U.S. patent application Ser. No. 11/313,136, filed Dec. 20, 2005 now U.S. Pat. No. 7,415,991, the disclosure of which is expressly incorporated by reference herein.

BACKGROUND AND SUMMARY OF THE INVENTION

The present invention relates to faucets for delivering water from a water source and, more particularly, to faucets for delivering potable water having reduced amounts of metal contaminants.

Current faucet systems for delivering potable water include a spout that dispenses the water from the water source. The spout is commonly formed of a metal, such as brass, chrome, or steel. Truly potable water should have only a minimal amount of chemical and metal contaminants. Accordingly, the type of metals used to form the spout and the size of the spout are typically limited in order to prevent or minimize the release of undesirable chemical and metal contaminants. For this reason less expensive, more corrosive metals, such as zinc, typically cannot be used in forming a spout for dispensing potable water, thus thwarting efforts to make less expensive faucets. Furthermore, the amount of metal contaminants released in the water is related to the size of the metal spout through which the water flows and is dispensed. For this reason, spout design and size is also typically limited.

Accordingly, a need remains for a faucet having a spout that minimizes the water's contact with metal, while enabling the use of less expensive metals, retaining the aesthetic qualities and durability of the rigid metal spout, and/or providing flexibility in spout style and size.

The present invention provides a faucet having water isolator couplings. In one illustrative embodiment of the present disclosure, the faucet is used for delivering water from a water source and includes a spout body formed substantially of a metal. The spout body includes an inlet end, an outlet end and a chamber extending between the inlet end and the outlet end. A tube formed of a non-metallic material is enclosed within the chamber and extends between the inlet end and the outlet end. The tube has a receiving end disposed proximal the inlet end and a dispensing end disposed proximal the outlet end. The tube defines a passage extending between the receiving end and the dispensing end. The receiving end is in fluid communication with the water source to communicate the water through the passage. The faucet also includes an inlet coupling formed of a non-metallic material and having a central inlet opening extending therethrough. The inlet coupling is molded about the receiving end of the tube such that the receiving end of the tube is sealingly received within the central inlet opening. The faucet also includes an outlet coupling formed of a non-metallic material and having a central outlet opening extending therethrough. The outlet coupling is molded about the dispensing end of the tube such that the dispensing end of the tube is sealingly received within the central outlet opening. The inlet coupling is sealingly coupled to the inlet end of the spout body to secure the receiving end of the tube to the inlet end of the spout body, and the outlet coupling is sealingly coupled to the outlet end of the spout body to secure the dispensing end of the tube to the outlet end of the spout body, such that the water received in the passage is prevented from entering an area of the chamber between the tube and the spout body.

In one illustrative embodiment of the present disclosure, the inlet coupling has an elongate body defining a central inlet opening extending therethrough. The central inlet opening is in communication with the passage and defines a first end and a second end. The first end sealingly receives the receiving end of the tube. The inlet coupling has a plurality of snap-fingers defined in the second end. Each of the plurality of snap-fingers has an outwardly extending tab, which engages an edge of the inlet end of the spout body.

In another illustrative embodiment of the present disclosure, the inlet coupling has an elongate body defining a central inlet opening extending therethrough. The elongate body has a first end and an opposite second end. The receiving end of the tube is sealingly received in the central inlet opening at the first end. The elongate body has a groove extending about an outer surface of the elongate body adjacent the second end. The inlet coupling further includes a retaining clip. The groove receives a portion of the retaining clip, such that the retaining clip protrudes radially from the groove to engage the inlet end of the spout body.

In still another illustrative embodiment of the present disclosure, the outlet coupling includes an outlet coupling body formed of a non-metallic material and having a central outlet opening extending therethrough. The dispensing end of the tube is sealingly received within the central outlet opening. The outlet coupling body further includes a radially extending lip and a groove adjacent the lip. The outlet coupling includes a clip having a slot. The outlet coupling body is received in the slot such that the clip is at least partially disposed in the groove. The clip extends radially outward from the coupling and abuts the shoulder. The outlet coupling sealingly engages the outlet end of the spout body to secure the dispensing end of the tube to the outlet end of the spout body.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DESCRIPTION OF INVENTION

Figure 1:
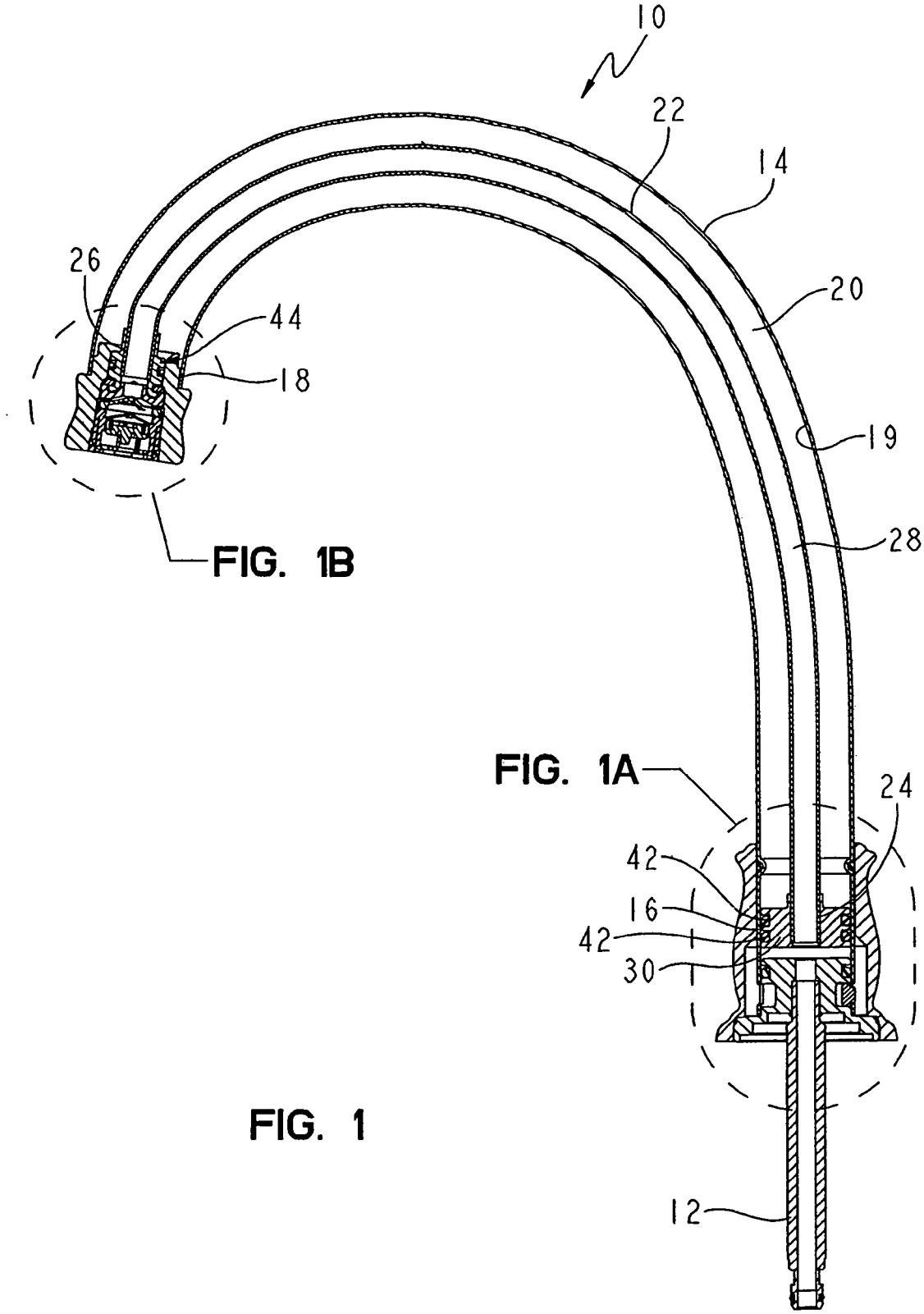
FIG. 1 is a sectional view of a faucet in accordance with one illustrative embodiment of the present disclosure.

Referring initially to FIG. 1, faucet 10, according to one illustrative embodiment of the present disclosure, generally includes spout body 14, tube 22 disposed within spout body 14, inlet coupling 30 connecting tube 22 to spout body 14 at one end, and outlet coupling 44 connecting tube 22 to spout body 14 at the other end.

More specifically, spout body 14 includes inlet end 16, outlet end 18 and chamber 20 extending through spout body 14 from inlet end 16 to outlet end 18. Chamber 20 is defined by inner wall 19. Spout body 14 is formed substantially of a rigid metal or metal alloy, such as brass, steel, zinc, or chrome. Although the advantages of the present disclosure are particularly appreciated when spout body 14 is formed substantially of metal, spout body 14 may be formed of other materials, such as plastic.

Tube 22 is enclosed within chamber 20 of spout body 14 and includes receiving end 24 positioned proximal inlet end 16 of spout body 14 and dispensing end 26 positioned proximal outlet end 18 of spout body 14. Passage 28 extends through tube 22 from receiving end 24 to dispensing end 26. Receiving end 24 is fluidly coupled to water source 12 to thereby communicate a flow of water from water source 12 to and through passage 28 of tube 22. Tube 22 is formed substantially of a non-metallic material, such as plastic, that releases little to no chemicals or metals into the water flowing through passage 28. In one illustrative embodiment, the material comprises a cross-linked polyethylene or PEX.

Figure 1B:
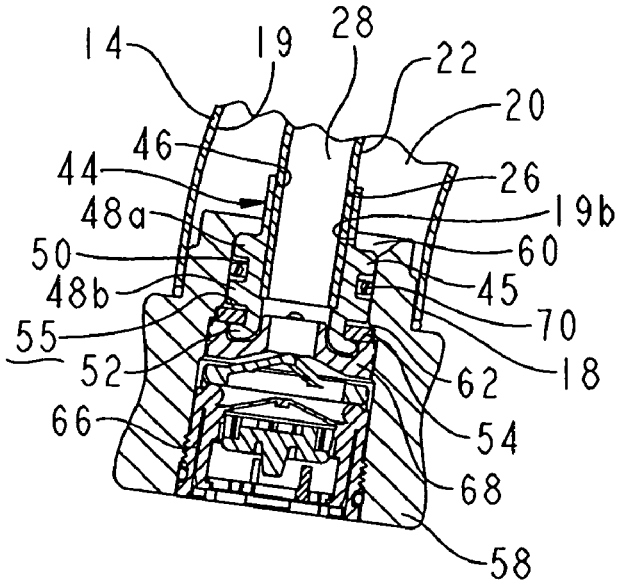
FIG. 1B is an enlarged view of the encircled region labeled as 1B in FIG. 1.
Figure 1A:
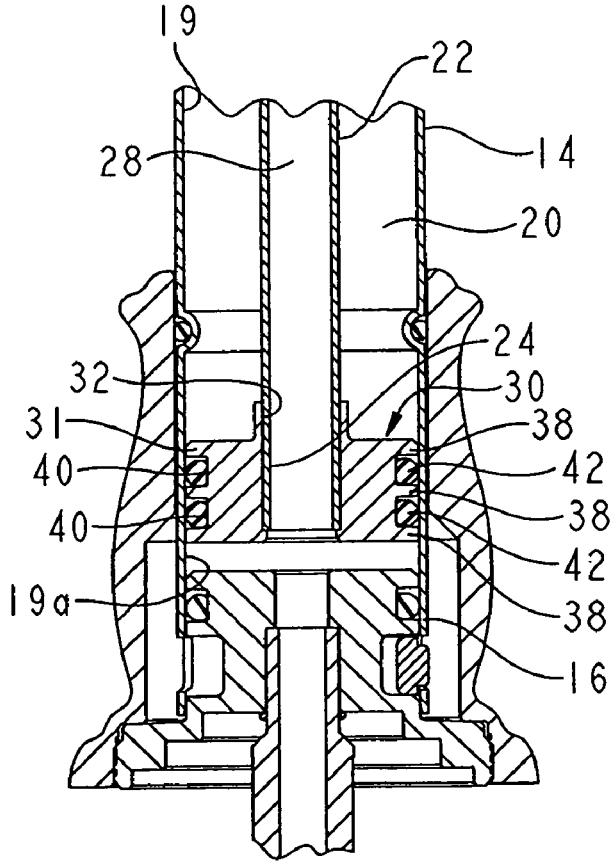
FIG. 1A is an enlarged view of the encircled region labeled as 1A in FIG. 1.

Turning now to FIGS. 1 and 1A, inlet coupling 30 includes inlet coupling body 31 formed substantially of a non-metallic material, such as plastic. Again, the material may illustratively comprise a cross-linked polyethylene or PEX. Inlet coupling body 31 defines central inlet opening 32 extending therethrough. Inlet coupling body 31 is disposed in chamber 20 of spout body 14 proximal inlet end 16. Receiving end 24 of tube 22 is sealingly received in central inlet opening 32. To achieve this sealed engagement, inlet coupling body 31 may be molded over and about receiving end 24 of tube 22. Alternatively, receiving end 24 of tube 22 may be sealingly engaged in central inlet opening 32 using any conventional means.

Referring still to FIGS. 1 and 1A, inlet coupling body 31 includes a plurality of flanges 38 extending radially outward from inlet coupling body 31. Flanges 38 illustratively contact inlet portion 19*a* of inner wall 19 at inlet end 16 of spout body 14 to couple and/or seal inlet coupling body 31 and attached receiving end 24 of tube 22 to inlet end 16 of spout body 14. Grooves 40 are formed in outer surface of inlet coupling body 31 between adjacent flanges 38. Grooves 40 receive sealing members 42, which bear against both inlet coupling body 31 and inlet portion 19*a* of inner wall 19 to further secure and seal inlet coupling body 31 to spout body 14. Sealing members 42 may be any object capable of creating a seal between inner wall 19 and inlet coupling body 31. For example, sealing members 42 may include O-rings, gaskets, bushings, or other sealing devices, and may be formed of rubber, plastic or other materials. Inlet coupling 30 sealingly couples receiving end 24 of tube 22 to inlet end 16 of spout body 14, such that water entering receiving end 24 of tube 22 from water source 12 does not enter chamber 20 of spout body 14 between inner wall 19 and tube 22.

Figure 2:
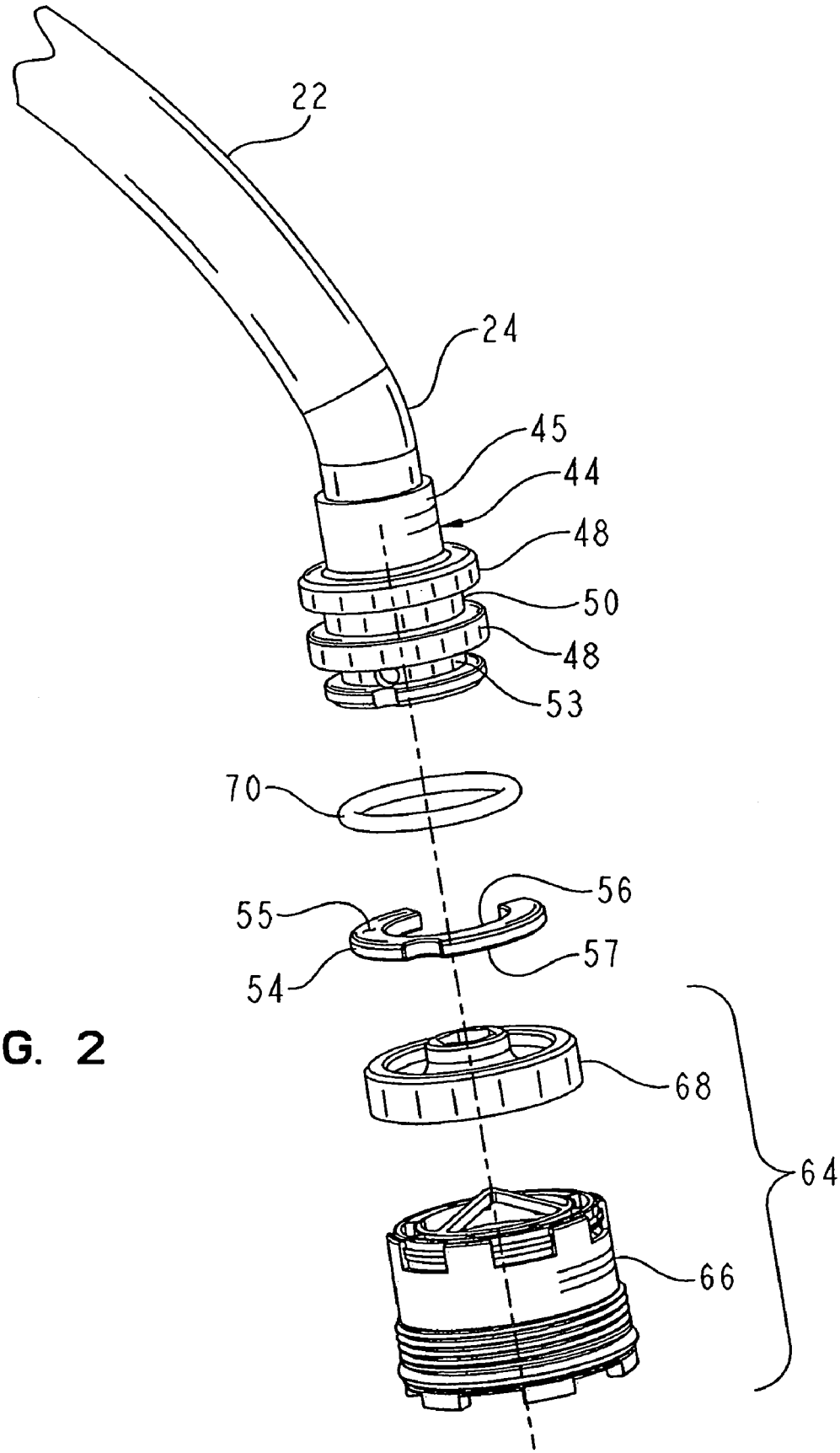
FIG. 2 is an exploded view of the dispensing end and outlet coupling assembly of the faucet in FIG. 1.

Referring now to FIGS. 1, 1B and 2, outlet coupling 44 includes outlet coupling body 45 formed substantially of a non-metallic material, such as plastic. Outlet coupling body 45 is disposed in chamber 20 of spout body 14 proximal outlet end 18. Outlet coupling body 45 defines central outlet opening 46 extending therethrough. Dispensing end 26 of tube 22 is sealingly received in central outlet opening 46. The sealed engagement of tube 22 to outlet coupling body 45 may be achieved using any conventional means, including molding coupling body 45 over and about dispensing end 26 of tube 22. Outlet coupling body 45 includes a pair of flanges 48*a*, 48*b* extending radially outward from coupling body 45 and defining groove 50 therebetween. Flanges 48*a*, 48*b* illustratively contact outlet portion 19*b* of inner wall 19 to secure and/or seal coupling body 45 to outlet end 18 of spout body. Outlet coupling 44 may also include sealing member 70. Sealing member 70 is disposed in groove 50 and bears against both outlet coupling body 45 and outlet portion 19*b* of inner wall 19 to further seal and secure outlet coupling body 45 to outlet end 18 of spout body 14. Sealing member 70 may include an O-ring, gasket, bushing, or other sealing device, and may be formed of rubber, plastic, or other materials.

As illustrated in FIG. 1B, outlet end 18 of spout body 14 may include aerator adapter 58. In the illustrated embodiment, aerator adaptor 58 defines outlet portion 19*b* of inner wall 19. As illustrated in FIG. 1B, aerator adapter 58 may be a component separate from the rest of spout body 14 and coupled to outlet end 18 of spout body 14 by any means such as press-fit, threaded engagement or other conventional means. Alternatively, aerator adapter 58 may be formed as one unit with spout body 14. In either case, for purposes of this description, aerator adapter 58 is considered to be a part of spout body 14. As already noted, aerator adapter 58 forms outlet portion 19*b* of inner wall 19. Outlet portion 19*b* of inner wall 19 includes first shoulder 60 and second shoulder 62 projecting inwardly from outlet portion 19*b* of inner wall 19. Flange 48*a* extends radially beyond first shoulder 60 and abuts first shoulder 60 to further secure outlet coupling body 45 to outlet end 18 of spout body 14.

Referring still to FIGS. 1B and 2, outlet coupling body 45 includes lip 52 extending radially outward from the outlet-most edge of outlet coupling body 45. Clip receiving groove 53 is defined by and between lip 52 and flange 48*b*. Outlet coupling 44 further comprises semi-circular retaining clip 54 having semi-circular receiving notch 56. Receiving notch 56 receives outlet coupling body 45 about groove 53 such that retaining clip 54 is partially disposed in and retained by groove 53. When assembled to outlet coupling body 45, retaining clip 54 extends radially outward from and substantially about outlet coupling body 45. When assembled to outlet coupling body 45, retaining clip 54 is positioned and adapted such that upper surface 55 of retaining clip 54 abuts second shoulder 62, as illustrated in FIG. 1B, and further sealingly secures outlet coupling body 45 to spout body 14.

Referring to FIGS. 1B and 2, faucet 10 may also include aerator assembly 64. Aerator assembly 64 illustratively includes aerator 66 and bolt 68. As shown in FIG. 1B, aerator 66 is threadedly received within the portion of chamber 20 defined by aerator adapter 58. Bolt 68 is positioned between aerator 66 and outlet coupling body 45. Bolt 68 is configured to receive lip 52 and bear against lower surface 57 (FIG. 2) of retaining clip 54. More particularly, when aerator 66 is secured within aerator adapter 58, aerator 66 forces bolt 68 to bear against lower surface 57 of clip 54 and press clip 54 against second shoulder 62. Outlet coupling 44 cooperates with aerator assembly 64 to sealingly engage outlet coupling body 45 and in turn, dispensing end 26 of tube 22, to outlet end 18 of spout body 14. The sealed engagement of outlet coupling body 45 to outlet end of spout body 14 prevents water exiting dispensing end 26 of tube 22 from entering chamber 20 of spout body 14 between tube 22 and inner wall 19.

Turning now to FIGS. 1, 1A and 1B, in operation, water flowing from water source 12 enters tube 22 at receiving end 24. As water flows from water source into tube 22, the sealed engagement between receiving end 24 and inlet end 16 by inlet coupling 30 prevents water from entering chamber 20 and contacting the metal of spout body 14. Because the water entering tube 22 does not contact the metal components of faucet 10, the amount of metal particles released into the water flowing through tube 22 is minimized. The water flowing through tube 22 is dispensed from tube 22 at dispensing end 26 after which the water flows through aerator 66 and out of faucet 10. As water flows from dispensing end 26 of tube 22, the sealed engagement between dispensing end 26 and outlet end 18 by outlet coupling prevents water from entering chamber 20 and contacting the metal of spout body 14. Because the water flowing through tube 22 and dispensed from tube 22 is isolated from the metal spout body, the amount of metal contaminants in the water ultimately dispensed is minimized.

Figure 3:
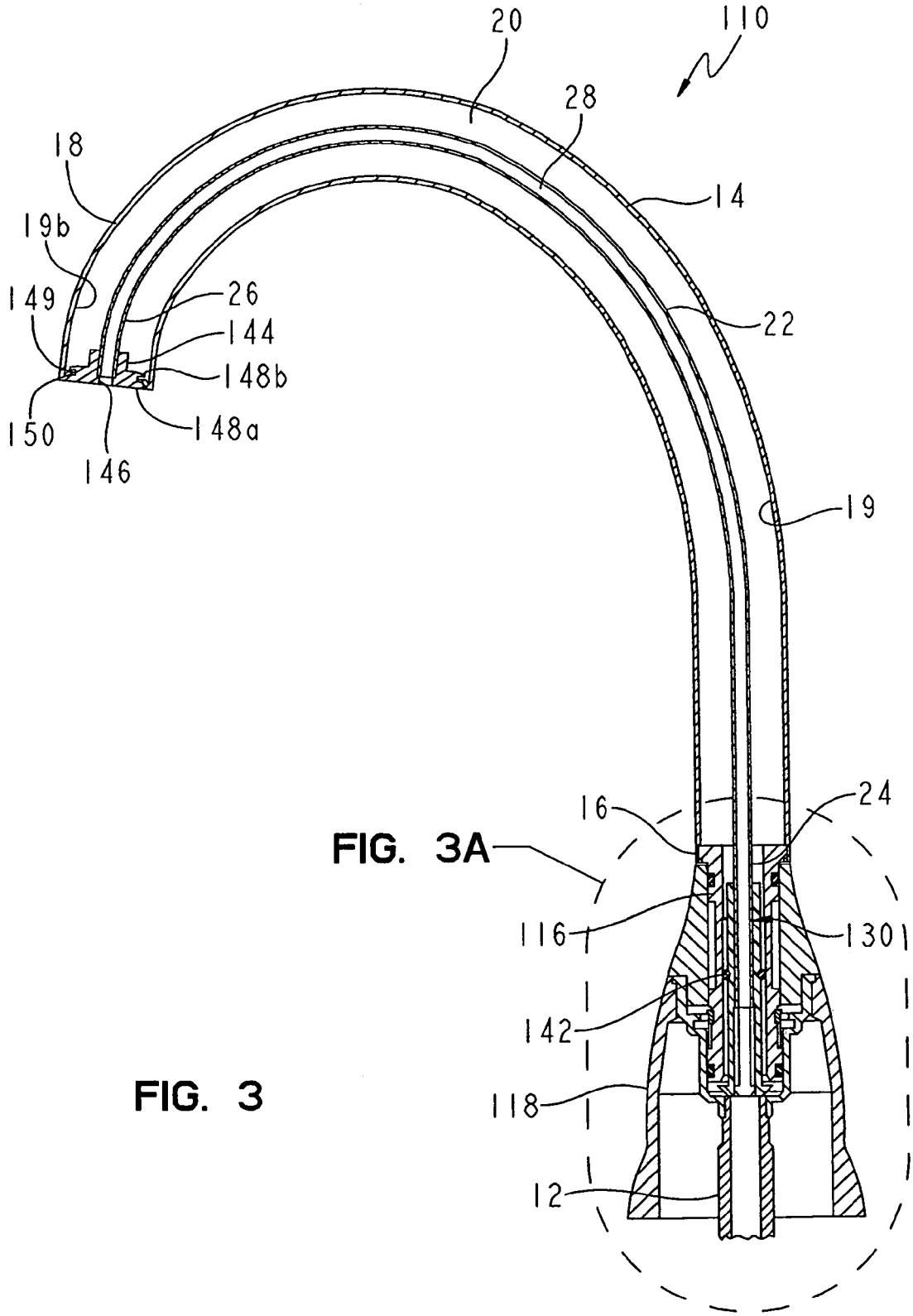
FIG. 3 is a sectional view of a faucet in accordance with another illustrative embodiment of the present disclosure.
Figure 3A:
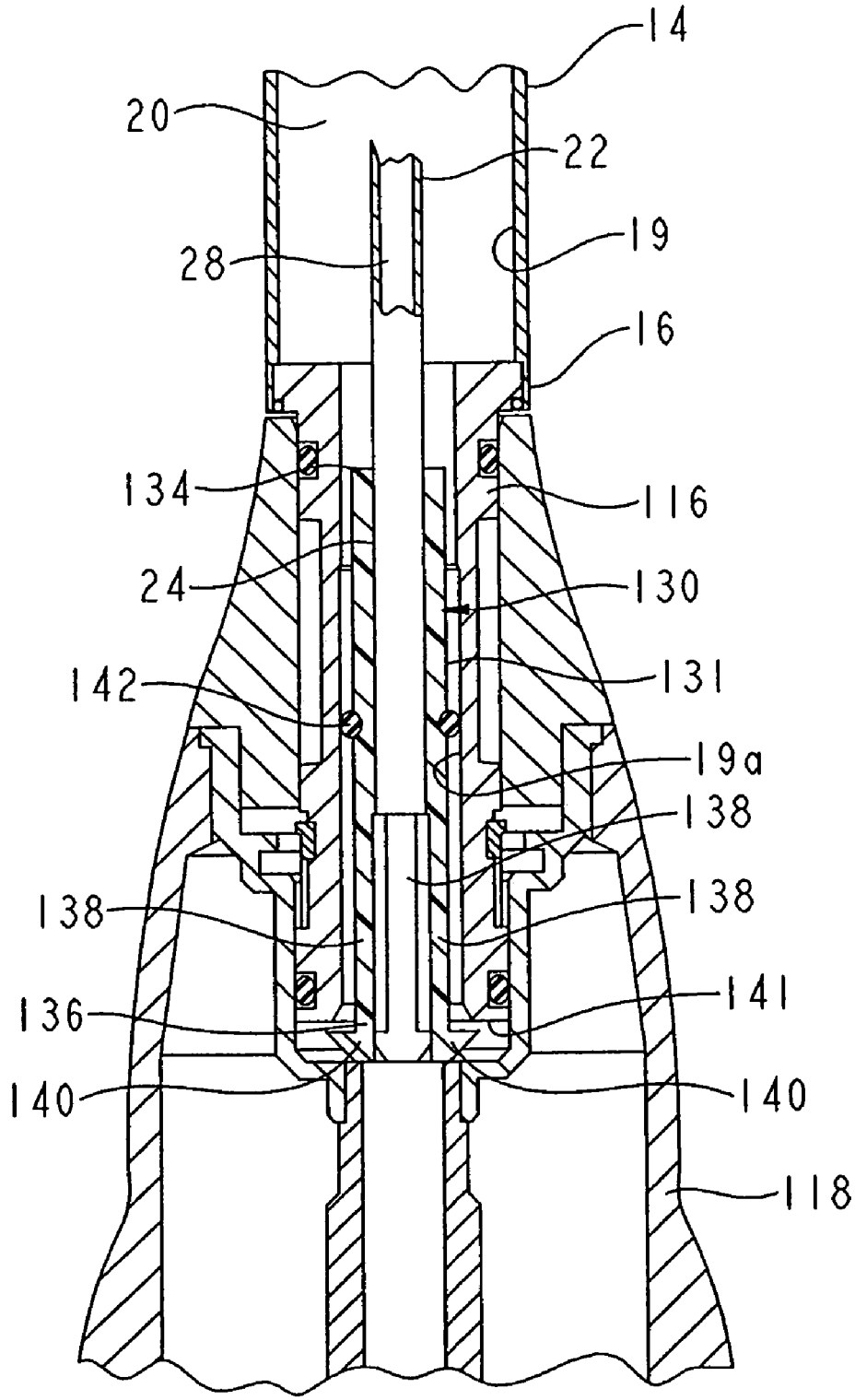
FIG. 3A is an enlarged view of the encircled region labeled 3A in FIG. 3.
Figure 4:
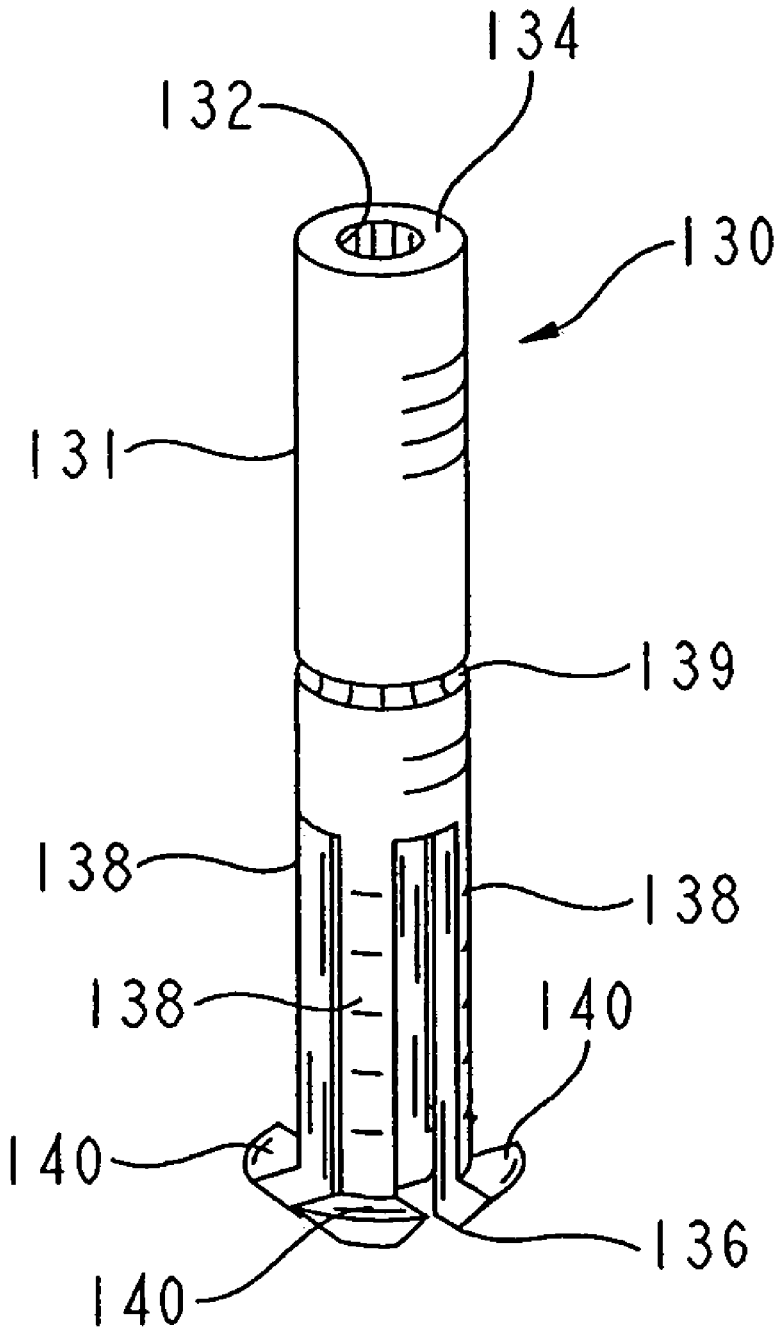
FIG. 4 is a perspective view of the inlet coupling of the faucet of FIG. 3A.

Turning now to FIGS. 3, 3A, and 4, another illustrative embodiment of the present disclosure is illustrated. Faucet 110 generally includes spout body 14, tube 22 disposed within spout body 14, inlet coupling 130 coupling tube 22 to spout body 14 at one end, and outlet coupling 144 coupling tube 22 to spout body 14 at the other end. Spout body 14 is substantially similar to that shown in FIG. 1 and includes inlet end 16, outlet end 18 and chamber 20 extending through spout body 14 from inlet end 16 to outlet end 18. Chamber 20 is defined by inner wall 19 having inlet portion 19*a* at inlet end 16 and outlet portion 19*b* at outlet end 18. Spout body 14 may be formed of any rigid material, including metals, alloys and plastics. Spout body 14 may include inlet adapter 116 for fitting spout body 14 to faucet base 118. Inlet adapter 116 may be a discrete component attached to inlet end 16 of spout body 14, or may be formed integrally as part of one unit with inlet end 16 of faucet body 14. Furthermore, inlet adapter 116 may be formed of material similar to or different from spout body 14. In either case, for purposes of this description, inlet adapter 116 is considered part of spout body 14 and defines inlet portion 19*a* of inner wall 19.

Referring still to FIGS. 3, 3A and 4, similar to that shown in the embodiment of FIG. 1, tube 22 is enclosed within chamber 20 of spout body 14 and includes receiving end 24, which is positioned proximal inlet end 16 of spout body 14, and dispensing end 26, which is positioned proximal outlet end 18 of spout body 14. Tube 22 defines passage 28 extending therethrough from receiving end 24 to dispensing end 26. Receiving end 24 is fluidly coupled to water source 12 thereby communicating water from water source 12 to and through passage 28. Tube 22 is formed substantially of a non-metallic material, such as plastic, that releases little to no chemicals or metals into the water flowing through passage 28.

Referring now to FIGS. 3A and 4, inlet coupling 130 includes elongate body 131 extending between first end 134 and second end 136. Inlet coupling 130 is disposed substantially within chamber 20 of faucet body 14 at inlet end 16. Elongate body 131 defines central inlet opening 132 extending through coupling 130 from first end 134 to second end 136. Receiving end 24 of tube 22 is sealingly received within central inlet opening 132 at first end 134 of inlet coupling 130. Inlet coupling 130 is formed of a non-metallic material, such as plastic. Receiving end 24 of tube 22 may be sealingly received in central inlet opening 132 using any conventional means. For example, inlet coupling 130 may be molded directly over and about receiving end 24 of tube 22 such that inlet coupling 130 forms a single unit with tube 22. Second end 136 of inlet coupling 130 defines a plurality of snap fingers 138.

Snap fingers 138 are elongate fingers spaced apart from one another and having some resilience, such that snap fingers 138 may flex inward under pressure but snap back to original positions when pressure is relieved. Each of snap fingers 138 includes a tab 140 extending transversely or radially outward from the end of snap finger 138. Elongate body 131 also includes groove 139 extending about body 131. As shown in FIG. 3A the ends of snap fingers 138 protrude outwardly from chamber 20 at inlet end 16 such that tabs 40 overlap edge 141 of inlet end 16, thereby coupling receiving end 24 of tube 22 to inlet end 16 of spout body 14 and restricting movement of inlet coupling 130 and tube 22 within chamber 20. Sealing member 142 is disposed at least partially within groove 139 and bears against inlet portion 19*a* of inner wall 19 to sealingly engage inlet coupling 130, and attached tube 22, to spout body 14. Sealing member 142 may be any object capable of creating a fluid seal, including O-rings, bushings, washers, or gaskets. Snap fingers 138 and sealing member 142 cooperate to secure and seal inlet coupling 130 to spout body 14. By sealingly engaging receiving end 24 of tube 22 to inlet end 16 of spout body 14, inlet coupling 130 prevents the water entering receiving end 24 of tube 22 from entering chamber 20 between inner wall 19 of spout body 14 and tube 22. Inlet coupling 130 isolates the water from the metallic spout body 14 thereby preventing or minimizing the amount of metals released into the water.

Referring back to FIG. 3, outlet coupling 144 includes central outlet opening 146 extending therethrough. Dispensing end 26 of tube 22 is sealingly received in central outlet opening 146 by any conventional means. For instance, outlet coupling 144 may be molded directly over and about dispensing end 26 of tube 22, such that outlet coupling 144 forms a single unit with tube 22. Outlet coupling 144 includes flanges 148*a* and 148*b* extending radially outward from outlet coupling 144. A groove 149 is defined between flanges 148*a* and 148*b*. Spout body 14 includes lip 150 projecting inwardly from outlet portion 19*b* of inner wall 19. Lip 150 is received within groove 149. More particularly, flange 148*a* extends over lip 150 and bears against lip 150 to sealingly secure outlet coupling 144, and attached tube 22, to outlet end 18 of spout body 14. By sealingly engaging dispensing end 26 of tube 22 of outlet end 18 of spout body 14, outlet coupling 144 isolates the water flowing from dispensing end 26 from metal spout body 14.

Inlet coupling 130 and outlet coupling 144 cooperate to sealingly couple receiving end 24 and dispensing end 26 of tube 22 to inlet end 16 and outlet end 18 of spout body, respectively. In so doing, inlet and outlet couplings 130, 144 isolate the water entering and leaving faucet 110 from contacting the metal components, particularly, spout body 14.

Figure 5:
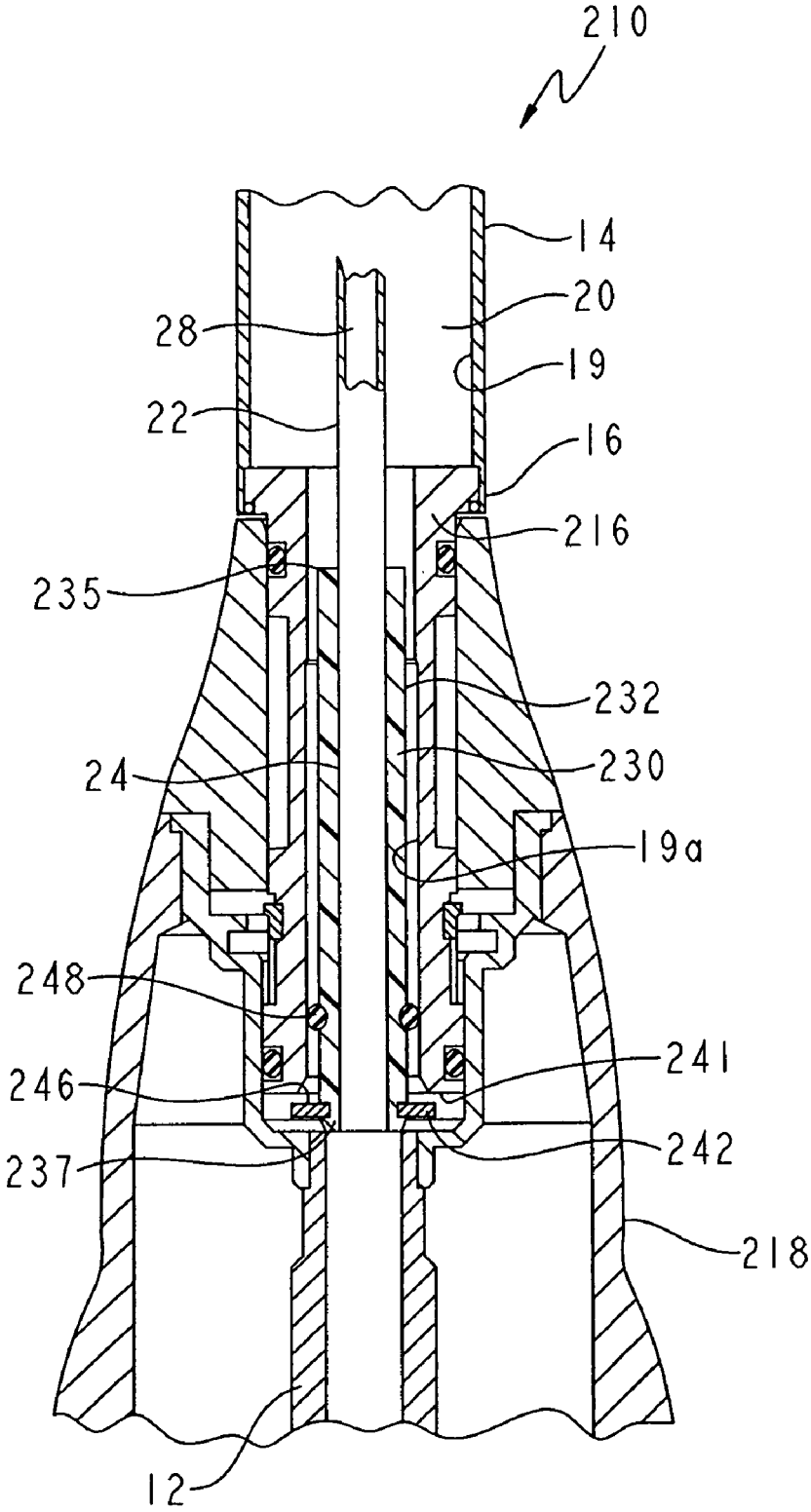
FIG. 5 is a sectional view of an inlet end of a faucet in accordance with another illustrative embodiment of the present disclosure.

Turning now to FIGS. 5-8, another illustrative embodiment of the present disclosure is illustrated. More particularly, FIG. 5 illustrates another embodiment of the receiving portion of the faucet 210. Receiving portion of faucet 210 includes spout body 14 defining chamber 20, tube 22 disposed within chamber 20 and defining passage 28, and inlet coupling 230 sealingly coupling the receiving end of tube 22 to inlet end 16 of spout body 14.

Chamber 20 of spout body 14 is defined by inner wall 19, which includes inlet portion 19*a*. Spout body 14 may include inlet adapter 216, which, similar to inlet adapter 116 of the previously-described embodiments, assists in fitting spout body 14 to faucet base 218. Inlet adapter 216 may be a discrete component attached to spout body 14 or may be formed as a single unit with spout body 14. In the illustrative embodiment, inlet adapter 216 forms inlet portion 19*a* of inner wall 19 of spout body 14.

Figure 7:
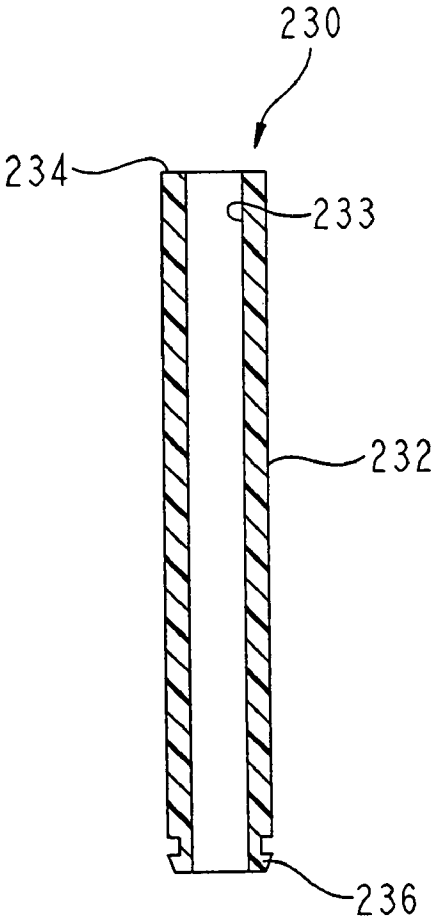
FIG. 7 is a sectional view of the inlet coupling of FIG. 6 taken along line 7-7.
Figure 6:
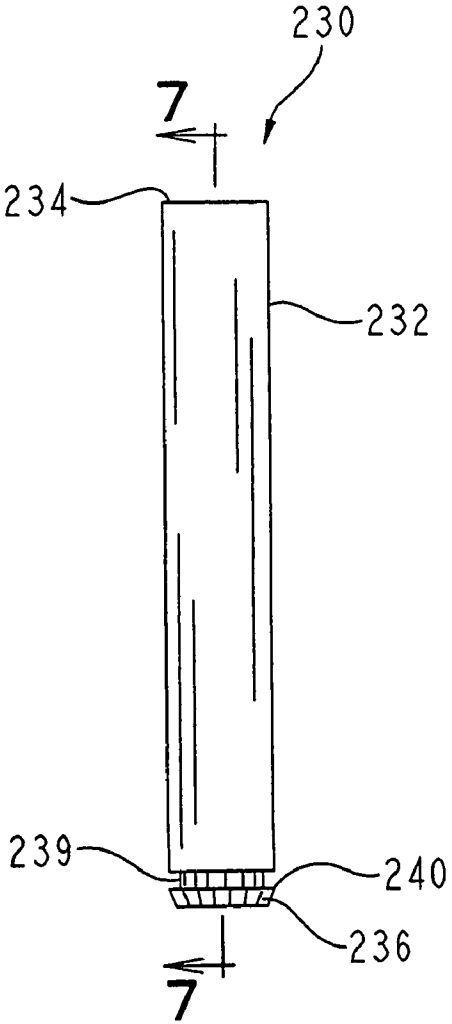
FIG. 6 is a side view of the inlet coupling of the faucet of FIG. 5.

Referring to FIGS. 5-7, inlet coupling 230 includes elongate body 232 extending between first end 234 and second end 236. Inlet coupling 230 defines central inlet opening 233 extending through body 232 from first end 234 to second end 236. Receiving end 24 of tube 22 is sealingly received in central inlet opening 233 by any means, such as molding inlet coupling 230 over and about receiving end 24 of tube 22. Inlet coupling 230 includes groove 239 extending about the outer surface of body 232. Groove 239 is formed near second end 236 such that tab 240 is formed at second end 236.

Figure 8:
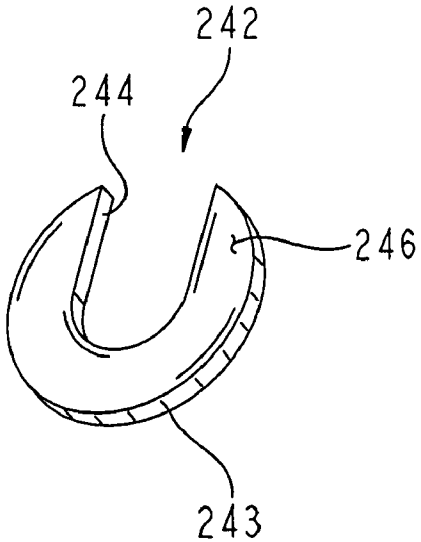
FIG. 8 is a perspective view of the retaining clip of the inlet coupling assembly of FIG. 5.

Referring to FIGS. 5 and 8, inlet coupling 230 also includes retaining clip 242. Retaining clip 242 includes semi-circular body 243 having upper surface 246 and cut-out or notch region 244. Notch 244 is adapted to receive body 232 at groove 239 (FIG. 6). The remainder of clip body 243 extends radially outward from coupling body 232, such that clip body 243 overlaps edge 241 of inlet end 16 of spout body 14. Upper surface 246 of clip contacts edge 241 to prevent movement of inlet coupling 230 and securely couples inlet coupling 230 to inlet end 16 of spout body 14. Sealing member 248 is sealingly disposed about body 232 of inlet coupling 230 and sealingly bears against inlet portion 19*a* of inner wall 19 to seal inlet coupling 230 to inner wall 19*a*.

Although the invention has been described in detail with reference to certain preferred embodiments, variations and modifications exist within the spirit and scope of the invention as described and defined in the following claims.

The invention claimed is:

1. A faucet for delivering water from a water source, said faucet comprising:

a spout body formed substantially of a metal and having an inlet end and an outlet end, said spout body defining a chamber extending between said inlet end and said outlet end;

a tube formed of a non-metallic material, said tube enclosed within said chamber and extending between said inlet end and said outlet end, said tube having a receiving end disposed proximal said inlet end and a dispensing end disposed proximal said outlet end, said tube defining a passage extending between said receiving end and said dispensing end, said receiving end in fluid communication with the water source to communicate the water to said passage;

an inlet coupling formed of a non-metallic material and having an elongate body defining a central inlet opening extending therethrough, said central inlet opening in communication with said passage, said elongate body having a first end sealingly receiving said receiving end of said tube and an opposite second end, said inlet coupling having a plurality of snap-fingers defined in said second end, each of said plurality of snap-fingers having a outwardly extending tab, said tab engaging an edge of said inlet end of said spout body; and an outlet coupling formed of a non-metallic material and having a central outlet opening extending therethrough, said dispensing end of said tube sealingly received within said central outlet opening;

wherein said inlet and outlet couplings sealingly engage said inlet and outlet ends, respectively, such that the water received in said passage is prevented from entering an area of said chamber between said tube and said spout body.

2. The faucet of claim 1 wherein said first end of said inlet coupling is molded over said receiving end of said tube and said outlet coupling is molded over said dispensing end of said tube.

3. The faucet of claim 1 wherein said inlet coupling further includes a sealing member, said sealing member extends about said elongate body and sealingly bears against said inlet end of said spout body.

4. The faucet of claim 1 wherein said outlet coupling includes at least one radially extending flange, said at least one flange bears against said outlet end.

5. The faucet of claim 4 wherein said at least one flange includes a plurality of flanges defining at least one groove therebetween, said outlet coupling includes a sealing member disposed at least partially within said at least one groove and sealingly bearing against said outlet end of said spout body.

6. The faucet of claim 4 wherein said outlet end includes an inner wall defining a portion of said chamber, said inner wall defines a first shoulder extending inwardly from said inner wall, said at least one flange extends over said shoulder to secure said outlet coupling in said position at said outlet end.

7. The faucet of claim 6 wherein said inner wall defines a second shoulder, and wherein said outlet coupling further includes a radially extending lip, and a second groove defined between said at least one flange and said lip, said outlet coupling includes a clip having a slot, said slot receiving said outlet coupling such that said clip is at least partially received in said second groove, said clip extends radially outward from said outlet coupling and engages said second shoulder.

8. The faucet of claim 7 further including an aerator assembly received within said chamber at said outlet end, said aerator assembly compressing said lip to said clip and said clip to said second shoulder to further secure said outlet coupling to said outlet end.

9. A faucet for delivering water from a water source, said faucet comprising:

a spout body formed substantially of a metal and having an inlet end and an outlet end, said spout body defining a chamber extending between said inlet end and said outlet end;

a tube formed of a non-metallic material, said tube enclosed within said chamber and extending between said inlet end and said outlet end, said tube having a receiving end disposed proximal said inlet end and a dispensing end disposed proximal said outlet end, said tube defining a passage extending between said receiving end and said dispensing end, said receiving end in fluid communication with the water source to communicate the water to said passage;

an inlet coupling formed of a non-metallic material and having an elongate body defining a central inlet opening extending therethrough, said elongate body having a first end and an opposite second end, said receiving end of said tube sealingly received in said central inlet opening at said first end, said elongate body having a groove extending about an outer surface of said elongate body adjacent said second end, said inlet coupling further including a retaining clip, said groove receiving a portion of said retaining clip, said retaining clip protruding radially from said groove to engage said inlet end of said spout body; and an outlet coupling formed of a non-metallic material and having a central outlet opening extending therethrough, said dispensing end of said tube sealingly received within said central outlet opening;

wherein said inlet and outlet couplings sealingly engage said inlet and outlet ends, respectively, such that the water is prevented from entering an area of said chamber between said tube and said spout body.

10. The faucet of claim 9 wherein said inlet coupling further includes a sealing member, said sealing member extends about said elongate body and bears against said inlet end of said spout body to sealingly engage said inlet coupling to said spout body.

11. The faucet of claim 9 wherein said first end of said inlet coupling is molded over said receiving end of said tube and said outlet coupling is molded over said dispensing end of said tube.

12. The faucet of claim 9 wherein said outlet coupling includes at least one radially extending flange, and wherein said outlet end includes an inner wall defining a portion of said chamber, said inner wall defines a first shoulder extending inwardly from said inner wall, said at least one flange extends over said shoulder to secure said outlet coupling in said chamber.

13. The faucet of claim 12 wherein said inner wall defines a second shoulder, and wherein said outlet coupling further includes a radially extending lip and a second groove defined between said at least one flange and said lip, said outlet coupling further includes a clip having a notch, said outlet coupling received in said notch such that at least a portion of said clip is disposed in said second groove, said clip extends radially outwardly from said coupling and engages said second shoulder.

14. The faucet of claim 13 further including an aerator assembly received within said chamber, said aerator assembly compressing said clip to said second shoulder to further secure said outlet coupling to said outlet end.

* * * * *